US010763589B2

(12) United States Patent
Wu et al.

(10) Patent No.: US 10,763,589 B2
(45) Date of Patent: Sep. 1, 2020

(54) MILLIMETER WAVE PATCH ANTENNAS WITH PARASITIC ELEMENTS

(71) Applicant: Apple Inc., Cupertino, CA (US)

(72) Inventors: Jiangfeng Wu, San Jose, CA (US); Yi Jiang, Cupertino, CA (US); Siwen Yong, San Francisco, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 93 days.

(21) Appl. No.: 16/031,964

(22) Filed: Jul. 10, 2018

(65) Prior Publication Data

US 2020/0021037 A1 Jan. 16, 2020

(51) Int. Cl.
*H01Q 1/38* (2006.01)
*H01Q 19/00* (2006.01)
(Continued)

(52) U.S. Cl.
CPC ..... *H01Q 19/005* (2013.01); *H01Q 5/385* (2015.01); *H01Q 5/392* (2015.01); *H01Q 9/0414* (2013.01); *H01Q 21/065* (2013.01)

(58) Field of Classification Search
CPC .... H01Q 19/005; H01Q 9/0414; H01Q 5/392; H01Q 21/065; H01Q 5/385
See application file for complete search history.

(56) References Cited

U.S. PATENT DOCUMENTS 5,661,494 A * 8/1997 Bondyopadhyay .... H01Q 1/364 343/700 MS
8,354,972 B2 1/2013 Borja et al.
(Continued)

FOREIGN PATENT DOCUMENTS

JP 2009284088 A * 12/2009

OTHER PUBLICATIONS

Alexander Bondarik* and Daniel Sjoberg, "Gridded Parasitic Patch Stacked Microstrip Antenna with Beam Shift Capability for 60 GHz Band", Progress in Electromagnetics Research B, vol. 62, 319-331, 2015 (Year: 2015).*
(Continued)

*Primary Examiner* — Dieu Hien T Duong
(74) *Attorney, Agent, or Firm* — Treyz Law Group, P.C.; Joseph F. Guihan

(57) ABSTRACT

An electronic device may be provided with wireless circuitry. The wireless circuitry may include one or more antenna structures and transceiver circuitry such as millimeter wave transceiver circuitry. Antenna structures in the wireless circuitry may include patch antennas that are organized in a phased antenna array. Each patch antenna may include an antenna resonating element and a parasitic element. The parasitic element for the patch antenna may have dielectric-filled openings formed between coplanar parasitic conductors. The parasitic conductors may include a central parasitic conductor, four rectangular parasitic conductors formed around the central parasitic conductor, and corner parasitic conductors formed at the corners of the parasitic element. The corner parasitic conductors may be non-rectangular. For example, the corner parasitic conductors may have first and second perpendicular edges and a straight or curved third edge that joins the first and second edges.

18 Claims, 16 Drawing Sheets

(51) Int. Cl.

| | |
|---|---|
| ***H01Q 5/385*** | (2015.01) |
| ***H01Q 9/04*** | (2006.01) |
| ***H01Q 21/06*** | (2006.01) |
| ***H01Q 5/392*** | (2015.01) |

(56) References Cited

U.S. PATENT DOCUMENTS

| | | | | |
|---|---|---|---|---|
| 9,864,943 | B2 | 1/2018 | Dokai | |
| 2015/0102977 | A1* | 4/2015 | Lockyear | H01Q 9/0407 343/893 |
| 2015/0194730 | A1* | 7/2015 | Sudo | H01Q 5/378 343/905 |
| 2015/0333407 | A1* | 11/2015 | Yamagajo | H01Q 9/0414 343/905 |
| 2016/0111790 | A1 | 4/2016 | Anguera Pros et al. | |
| 2019/0334246 | A1* | 10/2019 | Obata | H01Q 13/08 |

OTHER PUBLICATIONS

Zhang, Yue Ping, et al., "Antenna-in-package design for wirebond interconnection to highly integrated 60-GHz radios", IEEE Transactions on antennas and propagation 57.10 (2009): 2842-2852.

* cited by examiner

MILLIMETER WAVE PATCH ANTENNAS WITH PARASITIC ELEMENTS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high data rates, but may raise significant challenges. For example, millimeter wave communications are often line-of-sight communications and can be characterized by substantial attenuation during signal propagation. In addition, it can be difficult to support millimeter wave communications over a sufficiently wide frequency bandwidth.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include one or more antenna structures and transceiver circuitry such as millimeter wave transceiver circuitry. Antenna structures in the wireless circuitry may include patch antennas that are organized in a phased antenna array.

The antenna structures may include patch antennas formed on a dielectric substrate. The dielectric substrate may include multiple dielectric layers. A ground plane may be formed for a patch antenna. An antenna resonating element for the patch antenna may be formed from metal traces on a first dielectric layer. A parasitic element for the patch antenna may be formed from metal traces on a second dielectric layer. The patch antenna may have a first antenna feed that includes a first feed terminal coupled to the antenna resonating element and second feed terminal coupled to the antenna ground. The patch antenna may also have a second antenna feed that includes a first feed terminal coupled to the antenna resonating element and second feed terminal coupled to the antenna ground.

The parasitic element for the patch antenna may have dielectric-filled openings formed between coplanar parasitic conductors. The parasitic conductors may include a central parasitic conductor. Four rectangular parasitic conductors may be formed around the central parasitic conductor, with one rectangular parasitic conductor on each side of central parasitic conductor. Corner parasitic conductors may be formed at the corners of the parasitic element, with each rectangular parasitic conductor interposed between two of the corner parasitic conductors.

The corner parasitic conductors may be non-rectangular. For example, the corner parasitic conductors may have first and second perpendicular edges and a third edge that joins the first and second edges. The third edge may be straight or curved. The corner parasitic conductors may optimize the uniformity of the radiation pattern of the patch antenna.

A phased antenna array may include a plurality of patch antennas each having corner parasitic conductors. The plurality of patch antennas may be arranged in a grid defined by orthogonal grid lines and each patch antenna may have a longitudinal axis that is oriented at a non-parallel angle with respect to the orthogonal grid lines.

DETAILED DESCRIPTION

Figure 1:
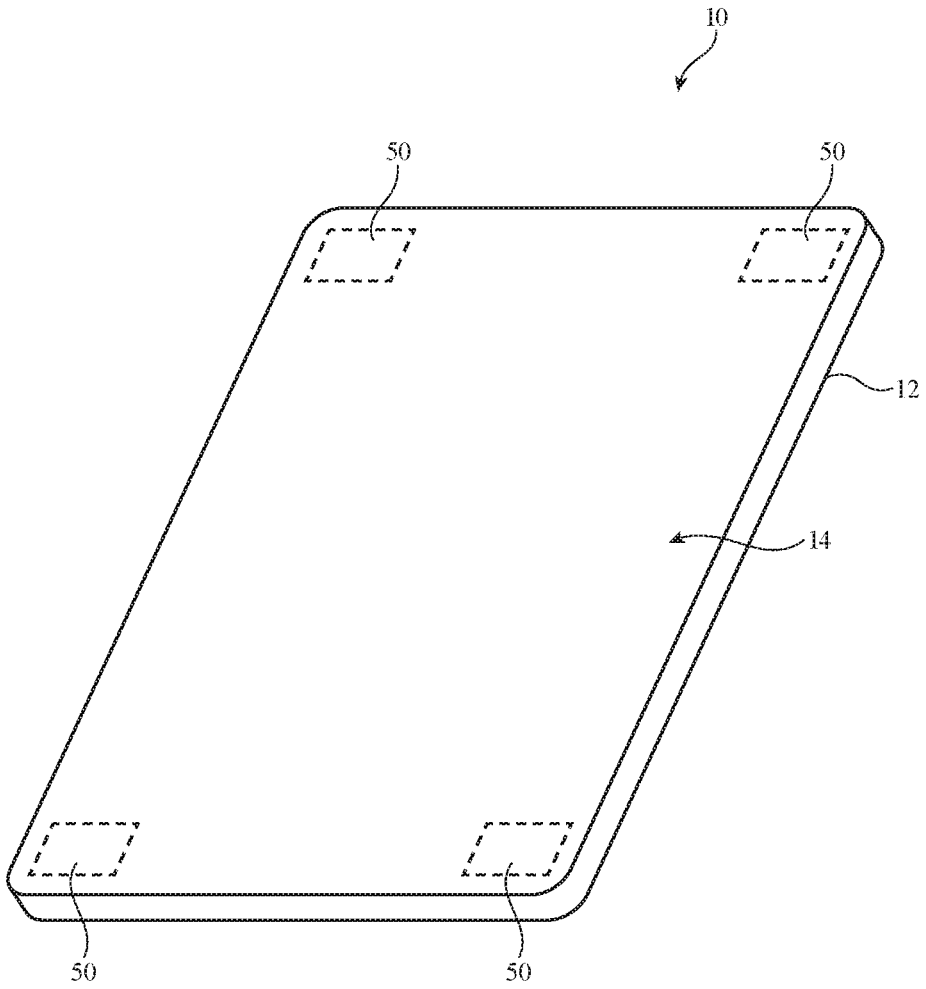
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Antennas within electronic device 10 may include stacked patch antennas for handling communications at frequencies between 10 GHz and 300 GHz. A stacked patch antenna may include an antenna resonating element and at least one parasitic antenna resonating element formed over the antenna resonating element. If care is not taken, electromagnetic energy can be trapped between the antenna resonating element and the parasitic antenna resonating element, thereby decreasing the overall antenna efficiency. In order to mitigate this trapping, slots may be formed in the parasitic antenna resonating element to divide the parasitic antenna resonating element into coplanar segments. This may serve to alter the electromagnetic boundary conditions defined by the parasitic antenna resonating element, thereby mitigating trapping of electromagnetic energy between the antenna resonating element and the parasitic antenna resonating element within a frequency band of interest.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
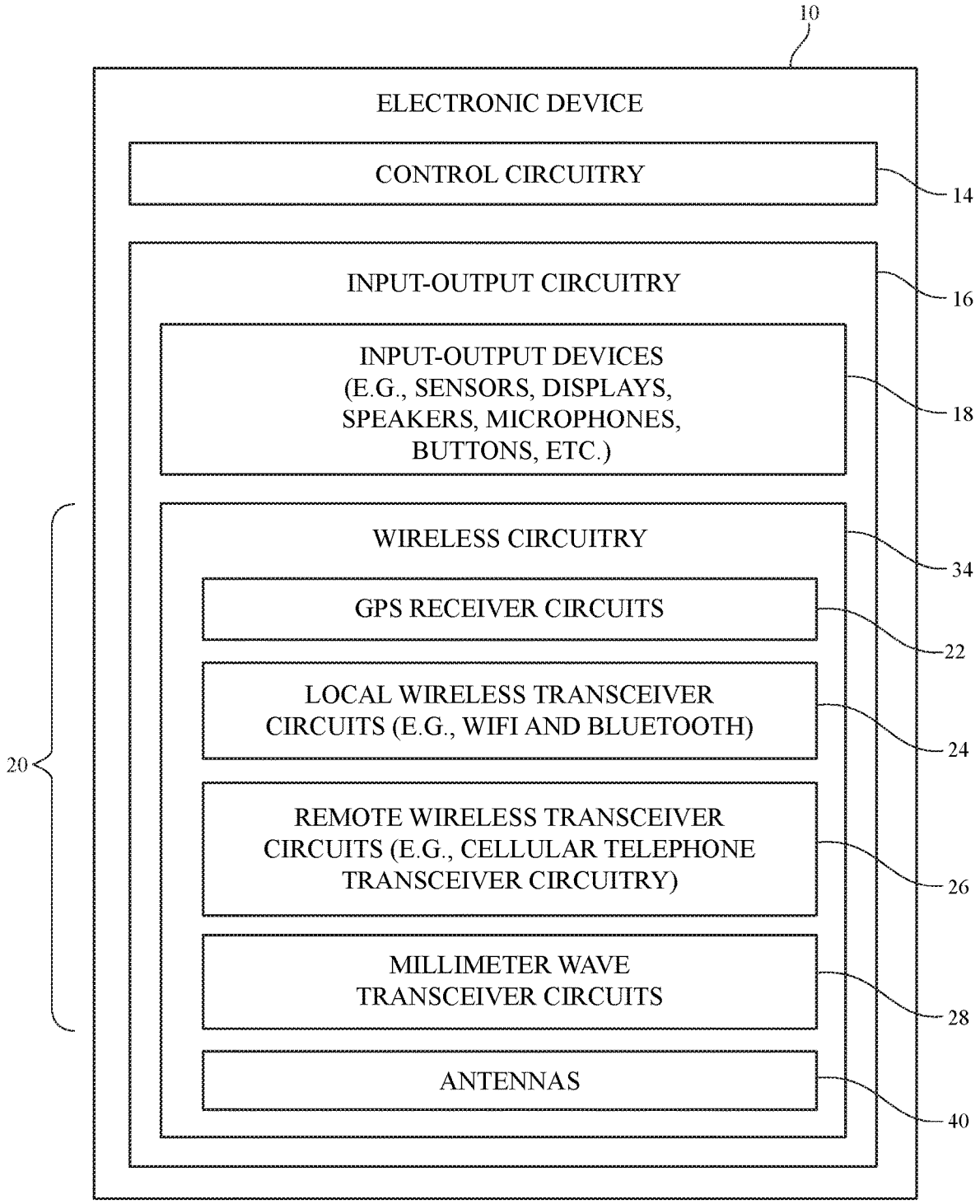
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metalized vias, microstrip transmission lines, stripline transmission lines, edge-coupled microstrip transmission lines, edge-coupled stripline transmission lines, waveguide structures, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
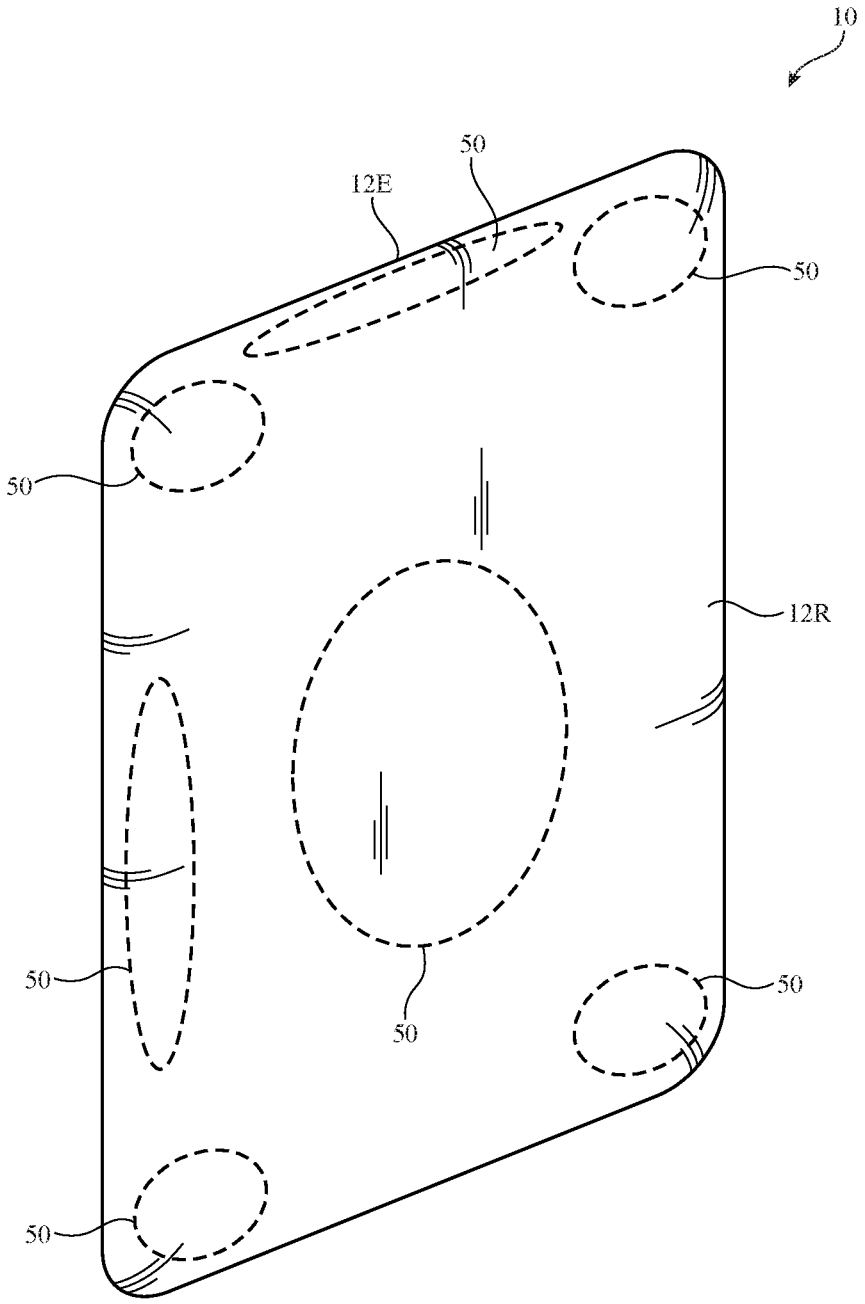
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. If desired, each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
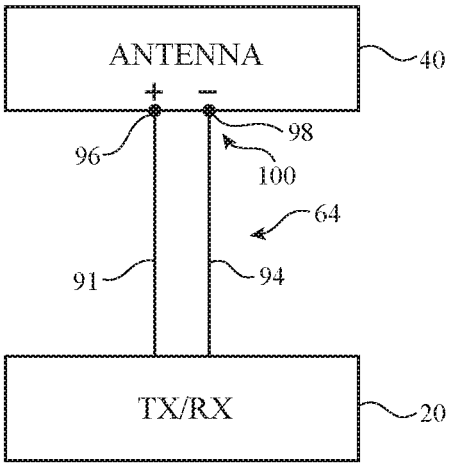
FIG. 4 is a diagram of an illustrative transceiver circuit and antenna in accordance with an embodiment.

A schematic diagram of an antenna 40 coupled to transceiver circuitry 20 (e.g., transceiver circuitry 28) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may include a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Transmission line paths such as path 64 may be used to route antenna signals within device 10. For example, transmission line paths may be used to couple antenna structures such as one or more antennas in an array of antennas to transceiver circuitry 20. Transmission lines in device 10 may include coaxial probes realized by metal vias, microstrip transmission lines, stripline transmission lines, edge-coupled microstrip transmission lines, edge-coupled stripline transmission lines, waveguide structures, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). Filter circuitry, switching circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals wireless transceiver circuits 28 may be implemented as phased antenna arrays. The radiating elements in a phased antenna array for supporting millimeter and centimeter wave communications may be patch antennas (e.g., stacked patch antennas), dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules.

Figure 5:
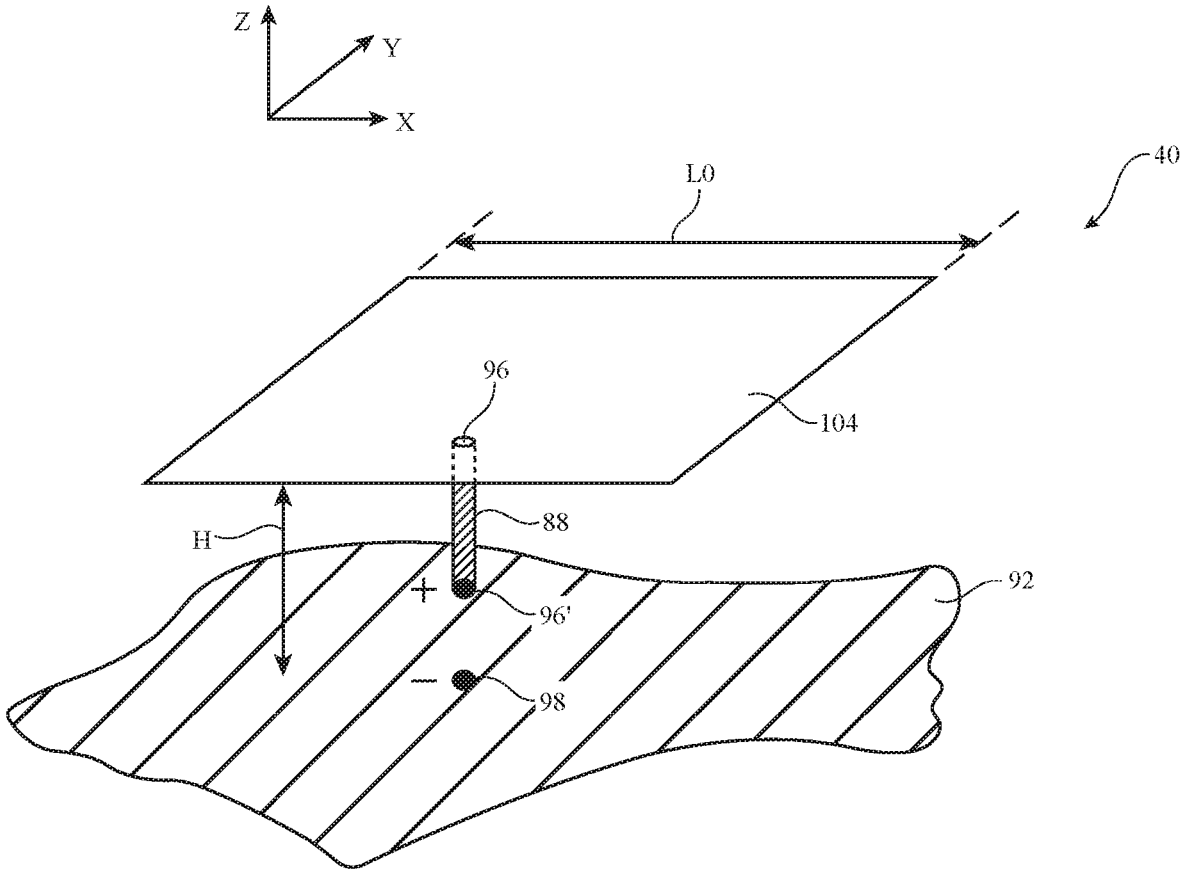
FIG. 5 is a perspective view of an illustrative patch antenna in accordance with an embodiment.

An illustrative patch antenna that may be used in conveying wireless signals at frequencies between 10 GHz and 300 GHz or other wireless signals is shown in FIG. 5. As shown in FIG. 5, patch antenna 40 may have a patch antenna resonating element 104 that is separated from and parallel to a ground plane such as antenna ground plane 92. Positive antenna feed terminal 96 may be coupled to patch antenna resonating element 104. Ground antenna feed terminal 98 may be coupled to ground plane 92. If desired, conductive path 88 (e.g., a coaxial probe feed) may be used to couple terminal 96' to terminal 96 so that antenna 40 is fed using a transmission line with a positive conductor coupled to terminal 96' and thus terminal 96. If desired, path 88 may be omitted and other types of antenna feed arrangements may be used. The illustrative feeding configuration of FIG. 5 is merely illustrative.

As shown in FIG. 5, patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground 92 may lie within a plane that is parallel to the plane of patch 104. Patch 104 and ground 92 may therefore lie in separate parallel planes that are separated by a distance H. Patch 104 and ground 92 may be formed from conductive traces patterned on a dielectric substrate such as a rigid or flexible printed circuit board substrate, metal foil, stamped sheet metal, electronic device housing structures, or any other desired conductive structures. The length of the sides of patch 104 may be selected so that antenna 40 resonates at a desired operating frequency. For example, the sides of patch 104 may each have a length L0 that is approximately equal to half of the wavelength (e.g., within 15% of half of the wavelength) of the signals conveyed by antenna 40 (e.g., in scenarios where patch 104 is substantially square).

The example of FIG. 5 is merely illustrative. Patch 104 may have a square shape in which all of the sides of patch 104 are the same length or may have a different rectangular shape (e.g., a non-square rectangular shape). If desired, patch 104 and ground 92 may have different shapes and orientations (e.g., planar shapes, curved patch shapes, patch shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension that is approximately equal to (e.g., within 15% of) half of the wavelength of operation, for example.

Figure 6:
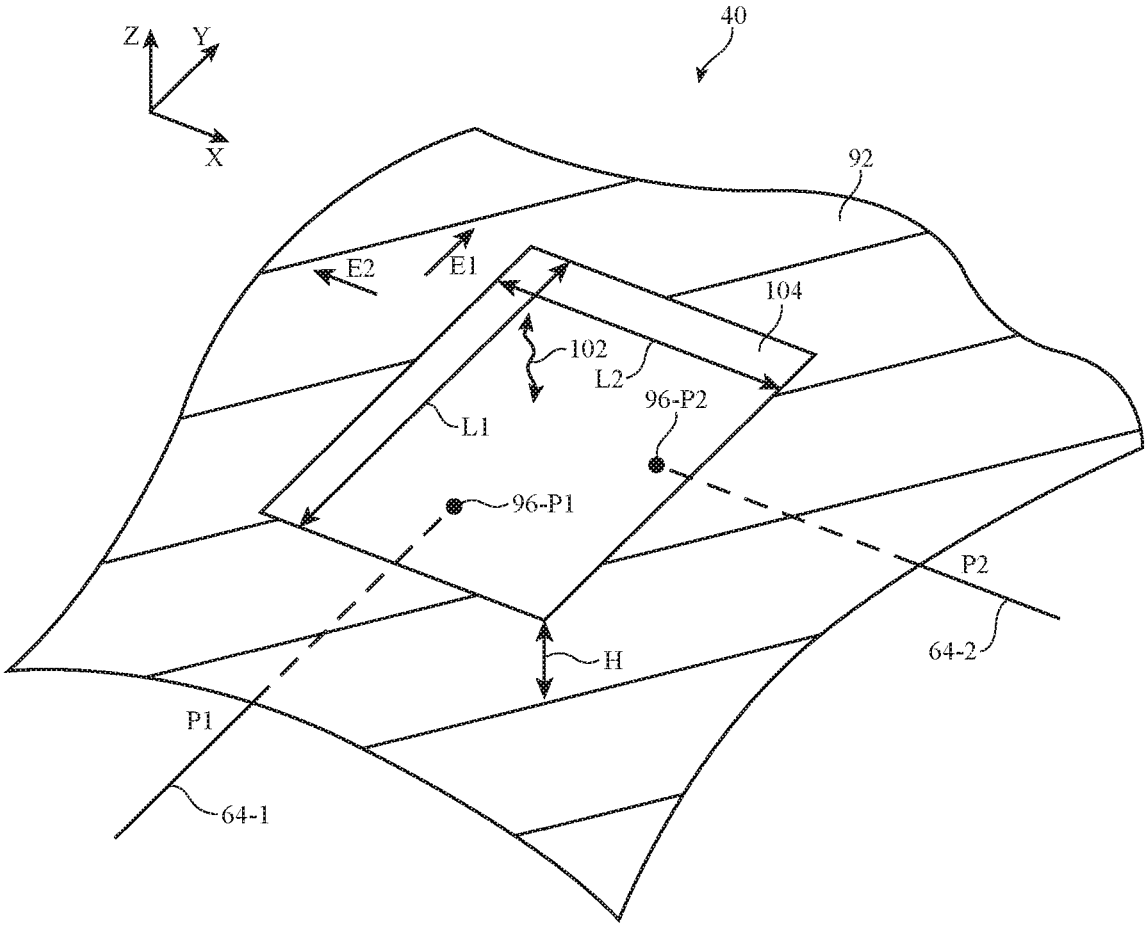
FIG. 6 is a perspective view of an illustrative patch antenna with dual ports in accordance with an embodiment.

To enhance the polarizations handled by patch antenna 40, antenna 40 may be provided with multiple feeds. An illustrative patch antenna with multiple feeds is shown in FIG. 6. As shown in FIG. 6, antenna 40 may have a first feed at antenna port P1 that is coupled to transmission line 64-1 and a second feed at antenna port P2 that is coupled to transmission line 64-2. The first antenna feed may have a first ground feed terminal coupled to ground 92 and a first positive feed terminal 96-P1 coupled to patch 104. The second antenna feed may have a second ground feed terminal coupled to ground 92 and a second positive feed terminal 96-P2 on patch 104.

Patch 104 may have a rectangular shape with a first pair of edges running parallel to dimension Y and a second pair of perpendicular edges running parallel to dimension X, for example. The length of patch 104 in dimension Y is L1 and the length of patch 104 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 102 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 102 associated with port P2 may be oriented parallel to dimension X so that the polarizations associated with ports P1 and P2 are orthogonal to each other). In scenarios where patch 104 is square (e.g., length L1 is equal to length L2), ports P1 and P2 may cover the same communications band. In scenarios where patch 104 is rectangular, ports P1 and P2 may cover different communications bands if desired. During wireless communications using device 10, device 10 may use port P1, port P2, or both port P1 and P2 to transmit and/or receive signals (e.g., millimeter wave signals at millimeter wave frequencies).

The example of FIG. 6 is merely illustrative. Patch 104 may have a square shape in which all of the sides of patch 104 are the same length or may have a rectangular shape in which length L1 is different from length L2. In general, patch 104 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

If care is not taken, antennas 40 such as single-polarization patch antennas of the type shown in FIG. 5 and/or dual-polarization patch antennas of the type shown in FIG. 6 may have insufficient bandwidth for covering an entirety of a communications band of interest (e.g., a communications band at frequencies greater than 10 GHz). For example, in scenarios where antenna 40 is configured to cover a millimeter wave communications band between 57 GHz and 71 GHz, patch 104 as shown in FIGS. 5 and 6 may have insufficient bandwidth to cover the entirety of the frequency range between 57 GHz and 71 GHz. If desired, antenna 40 may include one or more parasitic antenna resonating elements that serve to broaden the bandwidth of antenna 40.

Figure 7:
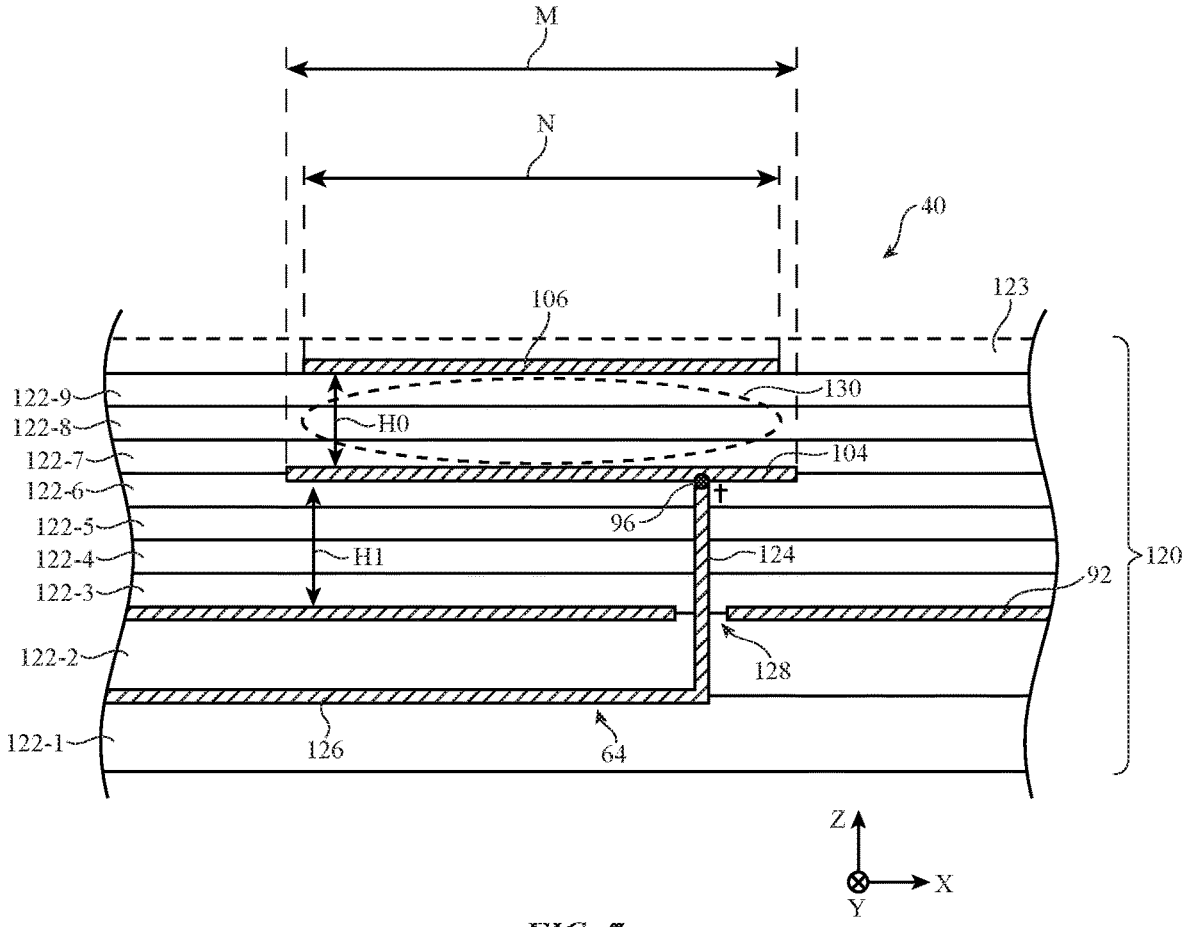
FIG. 7 is a cross-sectional side view of an illustrative patch antenna having a parasitic element in accordance with an embodiment.

FIG. 7 is a cross-sectional side view showing how antenna 40 may be provided with a bandwidth widening parasitic antenna resonating element. As shown in FIG. 7, antenna 40 may be formed on a dielectric substrate such as substrate 120. Substrate 120 may be, for example, a rigid or printed circuit board or other dielectric substrate. Substrate 120 may include multiple stacked dielectric layers 122 (e.g., multiple layers of printed circuit board substrate such as multiple layers of fiberglass-filled epoxy) such as a first dielectric layer 122-1, a second dielectric layer 122-2 over the first dielectric layer, a third dielectric layer 122-3 over the second dielectric layer, a fourth dielectric layer 122-4 over the third dielectric layer, a fifth dielectric layer 122-5 over the fourth dielectric layer, a sixth dielectric layer 122-6 over the fifth dielectric layer, a seventh dielectric layer 122-7 over the sixth dielectric layer, an eighth dielectric layer 122-8 over the seventh dielectric layer, and a ninth dielectric layer 122-9 over the eighth dielectric layer. Each layer 122 may have the same thickness (height) or two or more layers 122 may have different thicknesses. Additional dielectric layers 122 may be stacked within substrate 120 if desired.

With this type of arrangement, antenna 40 may be embedded within the layers of substrate 120. For example, ground plane 92 may be formed on a surface of second layer 122-2 whereas patch 104 of antenna 40 is formed on a surface of sixth layer 122-6. Antenna 40 may be fed using a transmission line 64 and an antenna feed that includes positive antenna feed terminal 96 coupled patch 104 and a ground antenna feed terminal coupled to ground plane 92. Transmission line 64 may, for example, be formed from a conductive trace such as conductive trace 126 on a surface of first layer 122-1 and portions of ground layer 92. Conductive trace 126 may form the positive signal conductor for transmission line 64 (e.g., positive signal conductor 91 as shown in FIG. 4).

A hole or opening 128 may be formed in ground layer 92. Transmission line 64 may include a vertical conductor 124 (e.g., a conductive through-via, conductive pin, metal pillar, solder bump, combinations of these, or other vertical conductive interconnect structures) that extends from trace 126 through layer 122-2, opening 128 in ground layer 92, and layers 122-3 through 122-6 to feed terminal 96 on patch 104. This example is merely illustrative and, if desired, other transmission line structures may be used (e.g., coaxial cable structures, stripline transmission line structures, etc.).

As shown in FIG. 7, one or more dielectric layers such as dielectric layers 122-7 through 122-9 may be formed over patch 104. A bandwidth widening parasitic antenna resonating element such as element 106 may be formed from conductive traces on a surface of layer 122-9. Parasitic antenna resonating element 106 may sometimes be referred to herein as parasitic resonating element 106, parasitic antenna element 106, parasitic element 106, parasitic patch 106, parasitic conductor 106, parasitic structure 106, or patch 106. Parasitic element 106 is not directly fed, whereas patch 104 is directly fed via transmission line 64 and feed terminal 96. Parasitic element 106 may create a constructive perturbation of the electromagnetic field generated by patch 104, creating a new resonance for antenna 40. This may serve to broaden the overall bandwidth of antenna 40 (e.g., to cover the entire millimeter wave frequency band from 57 GHz to 71 GHz).

Parasitic element 106 may be located at a distance H0 with respect to patch 104 (e.g., distance H0 may be equal to the sum of the thicknesses of layers 122-7, 122-8, and 122-9). Patch 104 may be located at a distance H1 with respect to ground plane 92 (e.g., distance H1 may be equal to the sum of the thicknesses of layers 12-3, 122-4, and 122-5). Distance H1 may be equal to, less than, or greater than distance H0. In practice, distances H1 and H0 may be adjusted to adjust the overall bandwidth of antenna 40.

Patch 104 may have a width M. As examples, patch 104 may be a rectangular patch (e.g., as shown in FIGS. 5 and 6) having a side of length M, a square patch having four sides of length M, a circular patch having diameter M, an elliptical patch having a major axis length M, or may have any other desired shape (e.g., where length M is the maximum lateral dimension of the patch, a length of a side of the patch such as the longest side of the patch, a length of a side of a rectangular footprint of the patch, etc.). The size of width M may be selected so that antenna 40 resonates at a desired operating frequency. For example, width M may be approximately equal to half of the wavelength (e.g., within 15% of half of the wavelength) of the signals conveyed by antenna 40 or less than this by a factor determined by the dielectric constant of substrate 120 (e.g., the dielectric constant of layers 122-1 through 122-9). For example, in scenarios where the dielectric constant of substrate 120 is CR, width M may be approximately equal to (e.g., within 15% of) the wavelength of operation of antenna 40 divided by two times the square root of CR. As examples, dielectric constant CR may be between 1.0 and 6.0, between 2.0 and 4.0, between 2.5 and 3.5, between 3.0 and 4.0, between 3.4 and 3.7, 3.6, 3.45, 3.5, 3.4, or any other desired value (e.g., depending on the material used in forming substrate 120). In the scenario where antenna 40 covers a millimeter wave frequency band from 57 GHz to 71 GHz, width M may be between 1.0 mm and 1.2 mm, for example.

Parasitic element 106 may have a width N. As examples, parasitic element 106 may be a rectangular patch having a side of length N, a square patch having four sides of length N, a circular patch having diameter N, an elliptical patch having a major axis length N, or may have any other desired shape (e.g., where length N is the maximum lateral dimension of the patch, a length of a side of the patch such as the longest side of the patch, a length of a side of a rectangular footprint of the patch, etc.). Width N may be the same as width M of patch 104, may be less than width M, or may be greater than width M. If desired, an optional dielectric layer 123 such as a solder mask layer may be formed over parasitic element 106 and layer 122-9 of substrate 120. Layer 123 may have a dielectric constant that is different from (e.g., greater than) the dielectric constant of layers 122. Width N may, for example, be approximately equal to the sum of the wavelength of operation of antenna 40 and a constant offset value, the sum being divided by two times the square root of the dielectric constant of layer 123. Layer 123 may be omitted if desired. A volume 130 may be defined between parasitic element 106 and patch antenna resonating element 104.

The example of FIG. 7 is merely illustrative. If desired, fewer or additional layers 122 may be interposed between trace 126 and ground 92, between ground 92 and patch 104, and/or between patch 104 and parasitic element 106. In one suitable arrangement, a single layer 122 is formed between patch 104 and ground 92 and a single layer 122 is formed between patch 104 and parasitic element 106. In another suitable arrangement, substrate 120 may be formed from a single dielectric layer (e.g., antenna 40 may be embedded within a single dielectric layer such as a molded plastic layer). In yet another suitable arrangement, substrate 120 may be omitted and antenna 40 may be formed on other substrate structures or may be formed without substrates. If desired, patch 104 and/or parasitic element 106 may be formed from conductive traces on one or more dielectric substrates, metal foil, stamped sheet metal, conductive electronic device housing structures, or any other desired conductive structures within device 10.

In FIG. 7, one parasitic element 106 is shown over patch 104. This example is merely illustrative. If desired, additional parasitic elements may be coplanar with parasitic element 106 (e.g., in a first layer of parasitic elements above patch 104). Additionally, one or more additional parasitic elements (e.g., a second layer of parasitic elements) may be formed above parasitic element 106 in a plane that is parallel to parasitic element 106. One or more intervening dielectric layers (e.g., additional dielectric layers 122) may separate parasitic element 106 from the additional parasitic elements formed over parasitic element 106.

Figure 8:
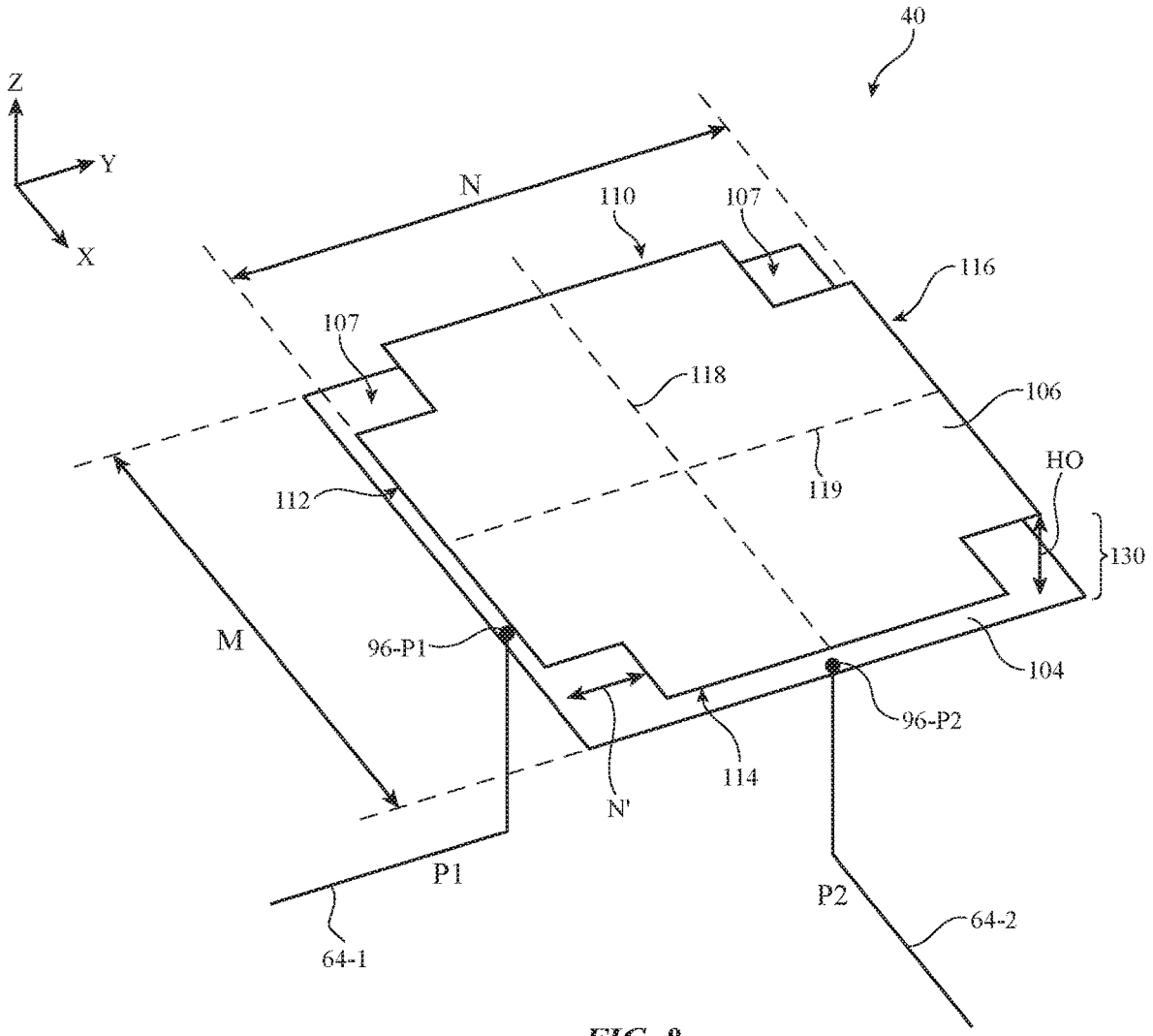
FIG. 8 is a perspective view of an illustrative patch antenna having a parasitic element in accordance with an embodiment.

In the example of FIG. 7, antenna 40 is shown as having only a single polarization (feed) for the sake of clarity. Antenna 40 may, if desired, be a dual-polarized patch antenna having two feeds (e.g., as shown in FIG. 6). FIG. 8 is a perspective view of antenna 40 having parasitic element 106 and two feeds for covering two orthogonal polarizations. In the example of FIG. 8, dielectric substrate 120, dielectric layer 123, and ground plane 92 are not shown for the sake of clarity.

As shown in FIG. 8, antenna 40 may have a first feed at antenna port P1 that is coupled to first transmission line 64-1 and a second feed at antenna port P2 that is coupled to a second transmission line 64-2. The first antenna feed may have a first ground feed terminal coupled to ground (e.g., ground 92 in FIG. 7) and a first positive feed terminal 96-P1 coupled to patch antenna resonating element 104 at a first location. The second antenna feed may have a second ground feed terminal coupled to ground and a second positive feed terminal 96-P2 coupled to patch antenna resonating element 104 at a second location. Feed terminal 96-P1 may be coupled to patch 104 adjacent to a first side of patch 104 whereas feed terminal 96-P2 is coupled to patch 104 adjacent to a second side of patch 104 that is perpendicular to the first side of patch 104, for example.

Parasitic element 106 may be formed over patch 104. At least some or an entirety of parasitic element 106 may overlap patch 104. In the example of FIG. 8, parasitic element 106 has a cross or "X" shape. In order to form the cross shape, parasitic element 106 may include notches or slots such as slots 107 (e.g., slots formed by removing conductive material from the corners of a square or rectangular metal patch). Cross-shaped parasitic element 106 may have a rectangular (e.g., square) outline or footprint. The width N of parasitic element 106 may be defined by the length of a side of the rectangular footprint of parasitic element 106, for example.

Parasitic element 106 may include a first arm 110, a second arm 112, a third arm 114, and a fourth arm 116 that extend from the center of parasitic element 106. First arm 110 opposes third arm 114 whereas second arm 112 opposes fourth arm 116 (e.g., arms 110 and 114 may extend in parallel and from opposing sides of the point at the center of parasitic element 106 and arms 112 and 116 may extend in parallel and from opposing sides of the point at the center of parasitic element 106). Arms 110 and 114 may extend along a first longitudinal axis 118 whereas arms 112 and 116 extend along a second longitudinal axis 119. Longitudinal axis 118 may be oriented at an angle of approximately 90° with respect to axis 119. In the example of FIG. 8, the combined length of arms 110 and 114 is equal to the combined length of arms 112 and 116 (e.g., each of arms 110, 112, 114, and 116 has the same length). This is merely illustrative and, in scenarios where two different linear polarizations are not used, arms 110, 112, 114, and/or 116 may have different lengths.

In a single-polarization patch antenna, the distance between the positive antenna feed terminal 96 and the edge of patch 104 may be adjusted to ensure that there is a satisfactory impedance match between patch 104 and the corresponding transmission line 64. However, such impedance adjustments may not be possible when the antenna is a dual-polarized patch antenna having two feeds. Removing conductive material from parasitic element 106 to form notches 107 may serve to adjust the impedance of patch 104 so that the impedance of patch 104 is matched to both transmission lines 64-1 and 64-2, for example. Notches 107 may therefore sometimes be referred to herein as impedance matching notches, impedance matching slots, or impedance matching structures.

The dimensions of impedance matching notches 107 may be adjusted (e.g., during manufacture of device 10) to ensure that antenna 40 is sufficiently matched to both transmission lines 64-1 and 64-2 and to tweak the overall bandwidth of antenna 40. In order for antenna 40 to be sufficiently matched to transmission lines 64-1 and 64-2, feed terminals 96-P1 and 96-P2 need to overlap with the conductive material of parasitic element 106. Notches 107 may therefore be sufficiently small so as not to uncover feed terminals 96-P1 or 96-P2. In other words, each of antenna feed terminals 96-P1 and 96-P2 may overlap with a respective arm of parasitic element 106. As an example, notches 107 may have sides with lengths N' that are equal to between 1% and 45% of width N of parasitic 106. During wireless communications using device 10, device 10 may use ports P1 and P2 to transmit and/or receive millimeter wave signals with two orthogonal linear polarizations.

The example of FIG. 8 is merely illustrative. If desired, parasitic element 106 may have additional notches 107, fewer notches 107, may have additional parasitic elements that fill notches 107, may have curved edges, straight edges, combinations of straight and curved edges, or any other desired shape (e.g., in scenarios where a dual linear polarized patch is not used). Each of notches 107 may have the same shape and dimensions or two or more of notches 107 may have different shapes or dimensions. The edges of parasitic element 106 and/or longitudinal axes 118 and 119 may each be parallel to at least one edge of patch 104. Each arm of parasitic element 106 may have the same width (e.g., as measured perpendicular to the corresponding longitudinal axis). In another scenario, two or more arms may have different widths (e.g., in scenarios where a dual linear polarized patch is not used). Parasitic element 106 may have any desired number of arms. In general, parasitic element 106 may be referred to herein as a cross-shaped parasitic element in any scenario where parasitic element 106 includes at least three arms extending from different sides of a common point on parasitic element 106, where the arms of parasitic element 106 extend along at least two non-parallel longitudinal axes.

When configured in this way, antenna 40 may cover a relatively wide millimeter wave communications band of interest such as a frequency band between 57 GHz and 71 GHz. The millimeter wave communications band of interested may be defined by a lower threshold frequency (e.g., 57 GHz) and an upper threshold frequency (e.g., 71 GHz). Parasitic element 106 and patch 104 may define boundaries of volume 130 between patch 104 and parasitic element 106. If care is not taken, antenna 40 may exhibit a cavity resonance within volume 130 at relatively high frequencies such as frequencies around the upper threshold frequency of the millimeter wave communications band of interest. This cavity resonance may serve to trap millimeter wave signals (energy) within volume 130 at these frequencies, thereby reducing the overall antenna efficiency of antenna 40 within the millimeter wave communications band of interest. This reduction in antenna efficiency may introduce errors in the wireless data conveyed by antenna 40 and/or may cause the corresponding millimeter wave communications link to be dropped.

In order to mitigate the trapping of millimeter wave signals within volume 130 at frequencies in the millimeter wave communications band of interest, parasitic element 106 may include one or more dielectric-filled openings. The openings may disrupt the cavity resonance between parasitic element 106 and patch 104 (e.g., by disrupting the boundary conditions of volume 130 and corresponding standing waves of EHF energy between elements 106 and 104). Such disruption of the cavity resonance may serve to mitigate the trapping of corresponding millimeter wave signals within volume 130 (e.g., so that the millimeter wave signals are radiated outwards and towards external communications equipment rather than remaining trapped within volume 130).

Figure 9:
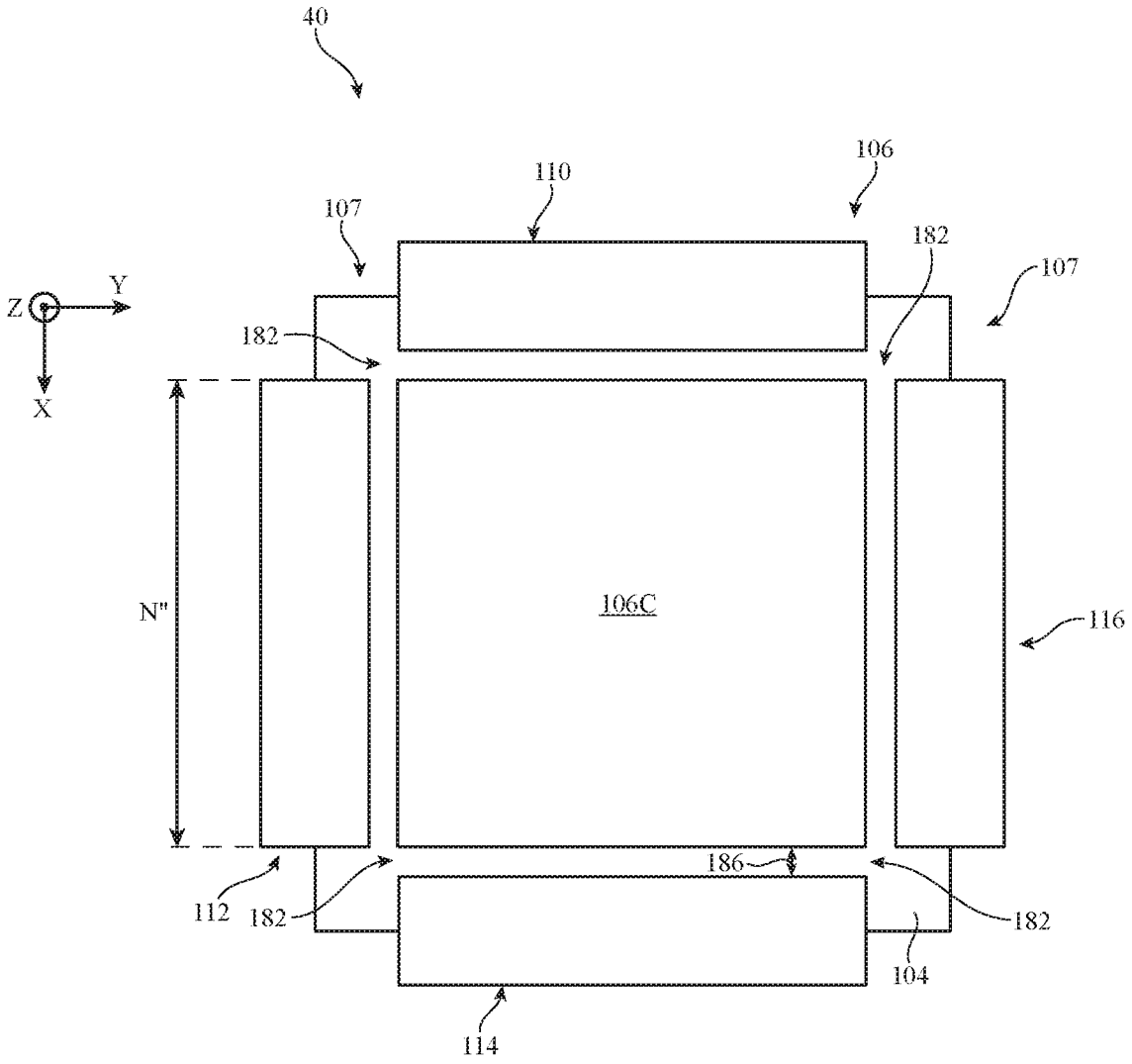
FIG. 9 is a top-down view of an illustrative patch antenna having a parasitic element with dielectric-filled openings in accordance with an embodiment.

FIG. 9 is a top-down view of an antenna that has a parasitic resonating element with dielectric-filled openings to mitigate the trapping of corresponding millimeter wave signals. As shown in FIG. 9, openings 182 may be formed in parasitic element 106. Openings 182 may, for example, separate arms 110, 112, 114, and 116 from a central portion 106C of parasitic element 106. If desired, openings 182 may be filled with a dielectric material such as plastic, glass, ceramic, epoxy, adhesive, integral portions of dielectric layer 122-9 or dielectric layer 123 (FIG. 7), or other dielectric materials. If desired, openings 182 may be filled with air. In yet another suitable arrangement, openings 182 may extend only partially through the thickness of parasitic element 106 (e.g., some of the conductive material in traces 106 may remain within openings 182 if desired).

In the example of FIG. 9, openings 182 each have a length that is equal to the width N" of central portion 106C and arms 110, 112, 114, and 116. Width N" may, for example, be equal to between 20% and 90% of the width N of the rectangular footprint of parasitic element 106. As examples, width N" may be between 0.7 mm and 0.8 mm, between 0.6 mm and 0.9 mm, between 0.5 mm and 0.8 mm, less than 0.5 mm, etc.

The example of FIG. 9 is merely illustrative. Additional openings may be formed within central portion 106C if desired. Openings 182 may follow straight paths and/or curved paths. Openings 182 may extend parallel to at least one edge of parasitic element 106 or may extend at non-parallel angles with respect to all of the edges of parasitic element 106. Openings 182 may extend only part way across the width N" of arms 110, 112, 114, and 116 if desired. Any desired number of openings 182 may be formed in parasitic antenna resonating element 106 (e.g., one opening 182, two openings 182, more than two openings 182, etc.). In another suitable arrangement, openings 182 may be omitted. In general, parasitic element 106 may have any desired shape, relative orientation with respect to the sides of antenna resonating element 104, number of arms and longitudinal axes, curved and/or straight edges, etc. When provided with openings 182, arms 110, 112, 114, and 116 and central portion 106C each form parasitic elements for patch 104 and may be referred to collectively herein as parasitic element 106. The separate conductive structures used to form arms 110, 112, 114, and 116, and central portion 106C (e.g., in scenarios where parasitic element 106 includes openings 182) may sometimes be referred to herein as separate parasitic conductors, parasitic segments, or parasitic patches (e.g., parasitic conductors 110, 112, 114, 116, and 106C, etc.).

If desired (although not shown in the example of FIG. 9), patch 104 may also have dielectric-filled openings to mitigate the trapping of millimeter wave signals. For example, patch 104 may be split into nine separate segments that are arranged in a 3×3 grid and separated by dielectric-filled openings (similar to openings 182 in FIG. 9). Patch 104 may have any desired number and arrangement of openings to split the antenna resonating element into any desired number of segments.

In practice, it may be desirable for antenna 40 to have as uniform a radiation pattern (e.g., around the Z-axis of FIG. 9) as possible (e.g., to ensure that antenna 40 can maintain satisfactory wireless communications with external equipment at any desired location around antenna 40). However, if care is not taken, discontinuities in parasitic element 106 of FIG. 9 may undesirably limit the symmetry and uniformity of the radiation pattern for antenna 40. If desired, antenna 40 may be provided with additional conductive structures (e.g., additional parasitics) that serve to optimize radiation pattern symmetry for antenna 40.

Figure 10:
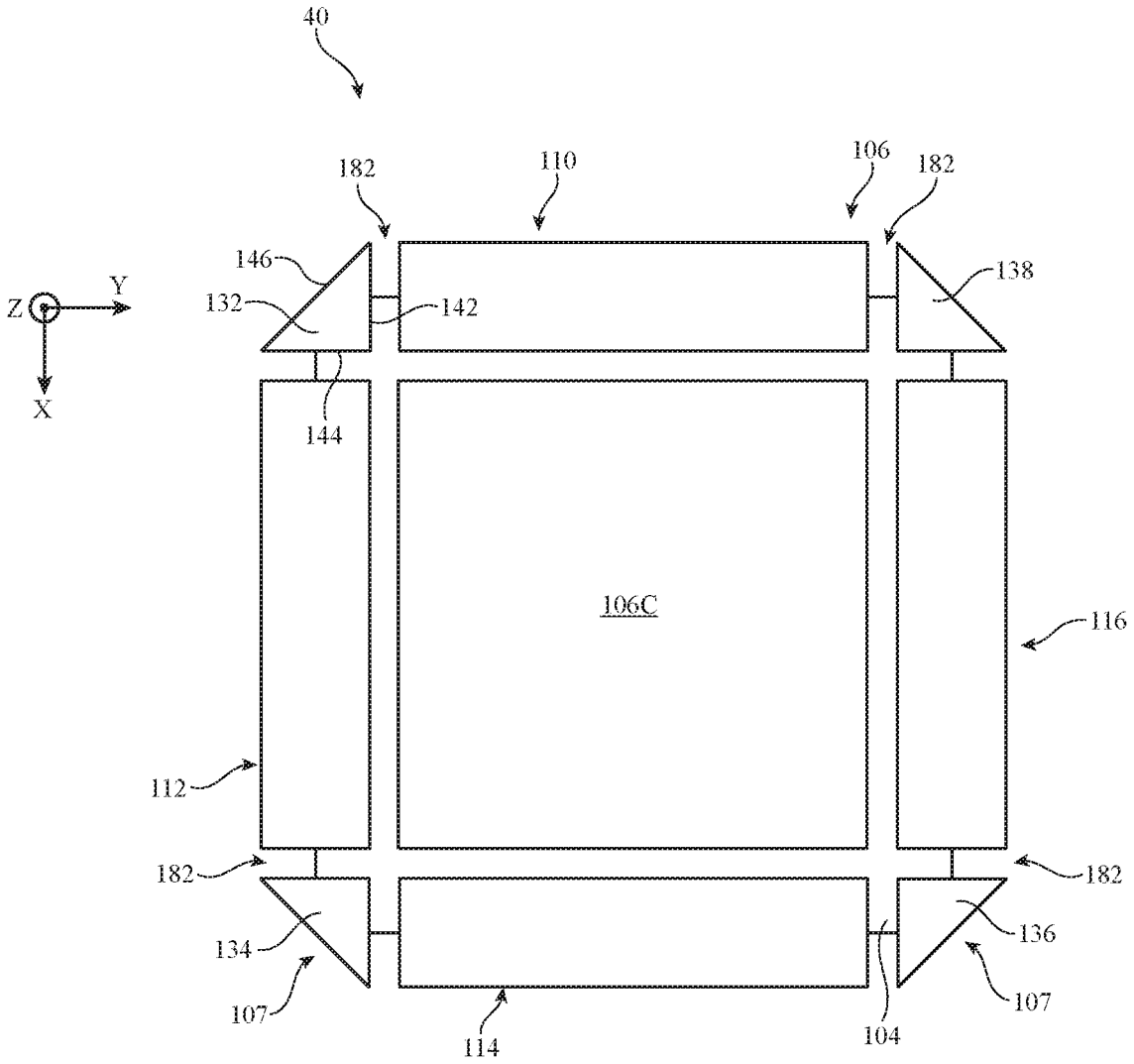
FIG. 10 is a top-down view of an illustrative patch antenna having a parasitic element with dielectric-filled openings and triangular shaped corner parasitic pieces in accordance with an embodiment.

FIG. 10 is a top-down view showing how antenna 40 may be provided with additional conductive structures for optimizing radiation pattern symmetry. As shown in FIG. 10, parasitic element 106 may include parasitic conductors 106C, 110, 112, 114, and 116 separated by openings 182. Parasitic element 106 may also include additional parasitic conductors such as parasitic conductors 132, 134, 136, and 138. Parasitic conductors 132, 134, 136, and 138 may be formed within notches 107 at the corners of parasitic element 106 of FIG. 9. Parasitic conductors 132, 134, 136, and 138 may therefore sometimes be referred to herein as corner parasitic pieces, corner parasitic patches, corner parasitic segments, corner parasitic conductors, parasitic corners, parasitic corner segments, parasitic corner conductors, parasitic corner patches, or parasitic corner pieces.

For example, parasitic element 106 may include a first parasitic corner conductor 132 between arms 110 and 112 (to the upper-left of parasitic conductor 106C of FIG. 9). Parasitic element 106 may include a second parasitic corner conductor 134 between arms 112 and 114 (to the lower-left of parasitic conductor 106C). Parasitic element 106 may include a third parasitic corner conductor 136 between arms 114 and 116 (to the lower-right of parasitic conductor 106C). Parasitic element 106 may include a fourth parasitic corner conductor 138 between arms 116 and 110 (to the upper-right of parasitic conductor 106C). Corner parasitic conductors 132, 134, 136, and 138 are separated from adjacent portions of parasitic element 106 by openings 182. Corner parasitic elements 132, 134, 136, and 138 are coplanar with central portion 106C and arms 110, 112, 114, and 116.

In the example of FIG. 10, each parasitic corner conductor has a triangular shape. For example, each corner parasitic element has first and second straight edges (sides) 142 and 144 that are perpendicular to each other. Edges 142 and 144 are joined by a straight edge 146 that completes the triangular shape. In other words, each parasitic corner conductor is a right triangle, with edge 146 forming the hypotenuse of the right triangle. This example is merely illustrative. In general, each parasitic corner conductor may have any desired shape (e.g., polygonal, square, rectangular, pentagonal, hexagonal, other irregular shapes, shapes with rounded corners, etc.).

The parasitic corner conductors 132, 134, 136, and 138 may optionally be separated from other portions of the parasitic element by openings 182. For example, in the embodiment of FIG. 10, openings 182 are formed between parasitic corner conductor 132 and arms 110 and 112, between parasitic corner conductor 134 and arms 112 and 114, between parasitic corner conductor 136 and arms 114 and 116, and between parasitic corner conductor 138 and arms 116 and 110. The example of FIG. 10 is merely illustrative. Additional openings may be formed within central portion 106C if desired. Openings 182 may follow straight paths and/or curved paths. Openings 182 may extend parallel to at least one edge of parasitic element 106 or may extend at non-parallel angles with respect to all of the edges of parasitic element 106. Openings 182 may extend only part way across the width N" of arms 110, 112, 114, and 116 if desired. Openings 182 may extend only part way between the parasitic corner conductors and adjacent arms of the parasitic element. Any desired number of openings 182 may be formed in parasitic element 106 (e.g., one opening 182, two openings 182, more than two openings 182, etc.). In another suitable arrangement, some or all of openings 182 may be omitted.

Figure 11:
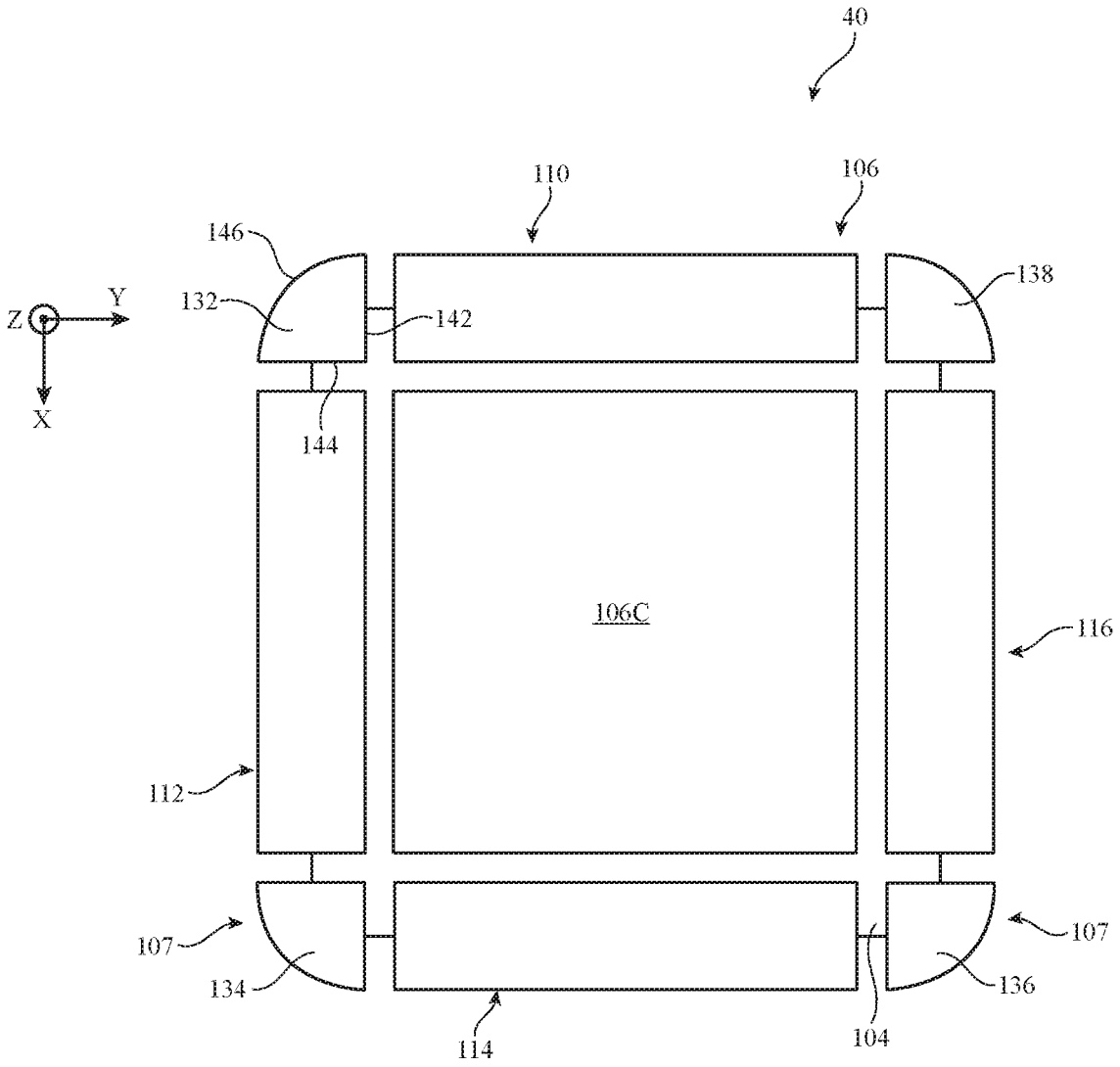
FIG. 11 is a top-down view of an illustrative patch antenna having a parasitic element with dielectric-filled openings and corner parasitic pieces with curved edges in accordance with an embodiment.

To further optimize the uniformity of the radiation pattern for antenna 40, the corner parasitic elements may have curved edges if desired. FIG. 11 is a top-down view of antenna 40 showing how the parasitic corner conductors may have curved edges. As shown in FIG. 11, each parasitic corner conductor again has first and second straight edges 142 and 144 that are perpendicular to each other. However, in FIG. 11 edges 142 and 144 are coupled by a curved edge 146. Edge 146 may have any desired degree (radius) of curvature. Providing the parasitic corner conductors with curved edges in this way may smooth out the radiation pattern for antenna 40 to provide an even more uniform radiation pattern than in scenarios where the parasitic corner conductors have straight edges, for example.

The shapes of the parasitic conductors shown in FIG. 11 are merely illustrative. Each parasitic corner conductor may have any desired shape with any desired number of edges and any desired combination of straight and curved edges. Any desired number of openings 182 may be formed in parasitic element 106.

Figure 12:
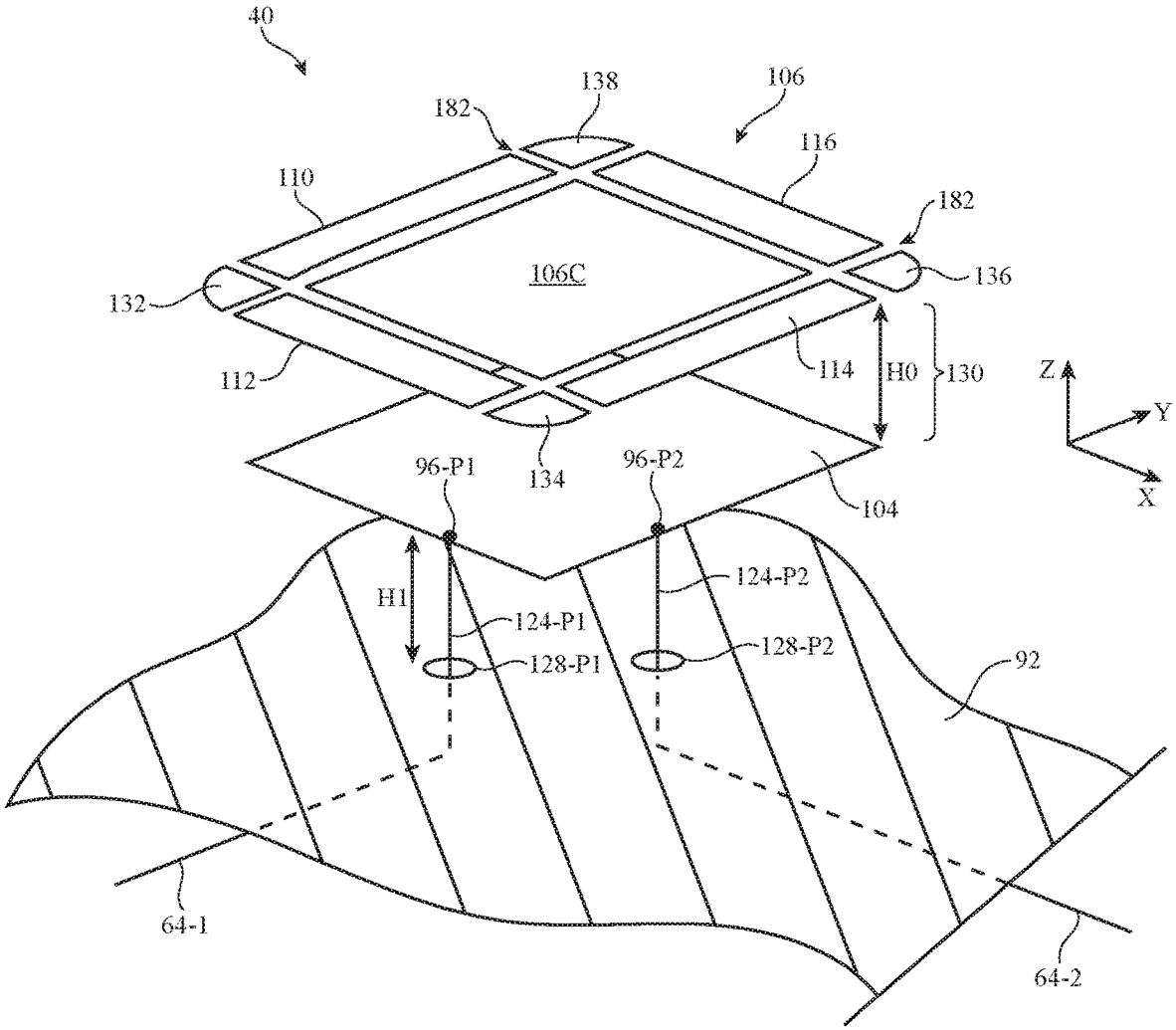
FIG. 12 is a perspective view of an illustrative patch antenna having a parasitic element with dielectric-filled openings and corner parasitic pieces with curved edges in accordance with an embodiment.

FIG. 12 is a perspective view of an antenna of the type shown in FIG. 11. As shown in FIG. 12, patch 104 may be located at distance H1 above ground plane 92. Parasitic element 106 (e.g., parasitic conductors 106C, 110, 112, 114, and 116, and parasitic corner conductors 132, 134, 136, and 138) may be located at distance H0 above patch antenna resonating element 104. Parasitic conductor 112 of parasitic element 106 may overlap first feed terminal 96-P1 whereas parasitic conductor 114 of parasitic element 106 overlaps second feed terminal 96-P2.

A first hole 128-P1 and a second hole 128-P2 may be formed in ground plane 92. Transmission line 64-1 (e.g., the corresponding vertical conductor 124-P1) may extend through hole 128-P1 to feed terminal 96-P1 on a first portion of resonating element 104. Transmission line 64-2 (e.g., the corresponding vertical conductor 124-P2) may extend through hole 128-P2 in ground plane 92 to feed terminal 96-P2 on a second portion of resonating element 104. If desired, vertical conductors 124-P1 and 124-P2 may pass through the same opening 128 in ground plane 92.

Volume 130 may be defined between parasitic element 106 and patch antenna resonating element 104. Openings 182 may be formed within parasitic element 106. For example openings 182 are formed between arms 110, 112, 114, and 116 and central portion 106C. Additionally, openings 182 are formed between corner parasitic piece 132 and arms 110 and 112, between corner parasitic piece 134 and arms 112 and 114, between corner parasitic piece 136 and arms 114 and 116, and between corner parasitic piece 138 and arms 116 and 110. By disrupting the cavity resonance associated with volume 130, millimeter wave signals that would otherwise be trapped within volume 130 may be radiated away from antenna 40.

Antennas of the type shown in FIGS. 5-12 may be arranged in an array (e.g., a phased antenna array). When arranged in a phased antenna array, it may be desirable to maximize the number of antennas that fit within a unit volume of the array (to maximize the gain of the phased antenna array). However, increasing the number of antennas per unit volume can degrade isolation between adjacent antennas, which may make beam steering with the phased antenna array difficult.

Figure 13:
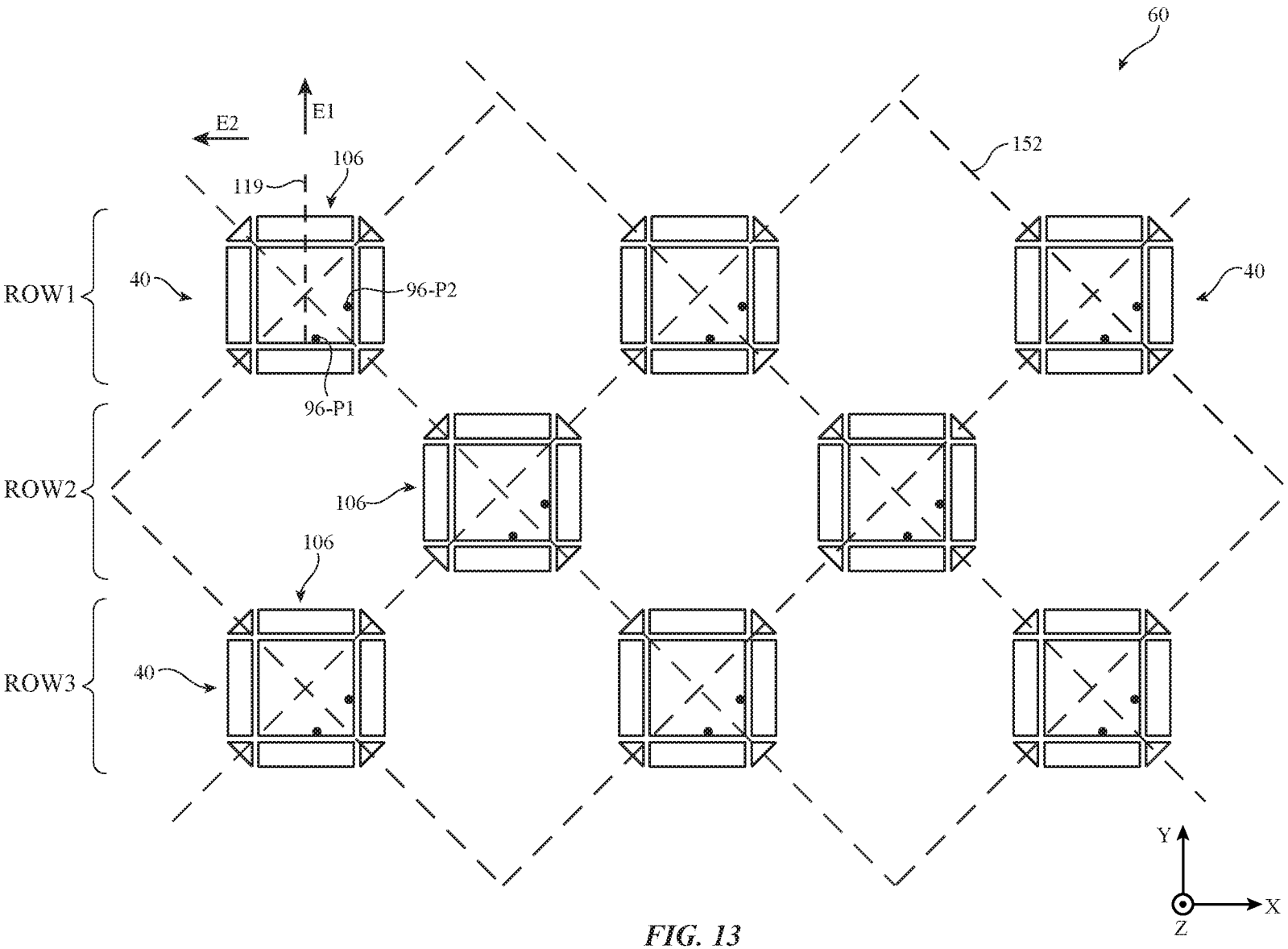
FIG. 13 is a top-down view of an illustrative phased antenna array including antennas arranged in a grid in accordance with an embodiment.
Figure 14:
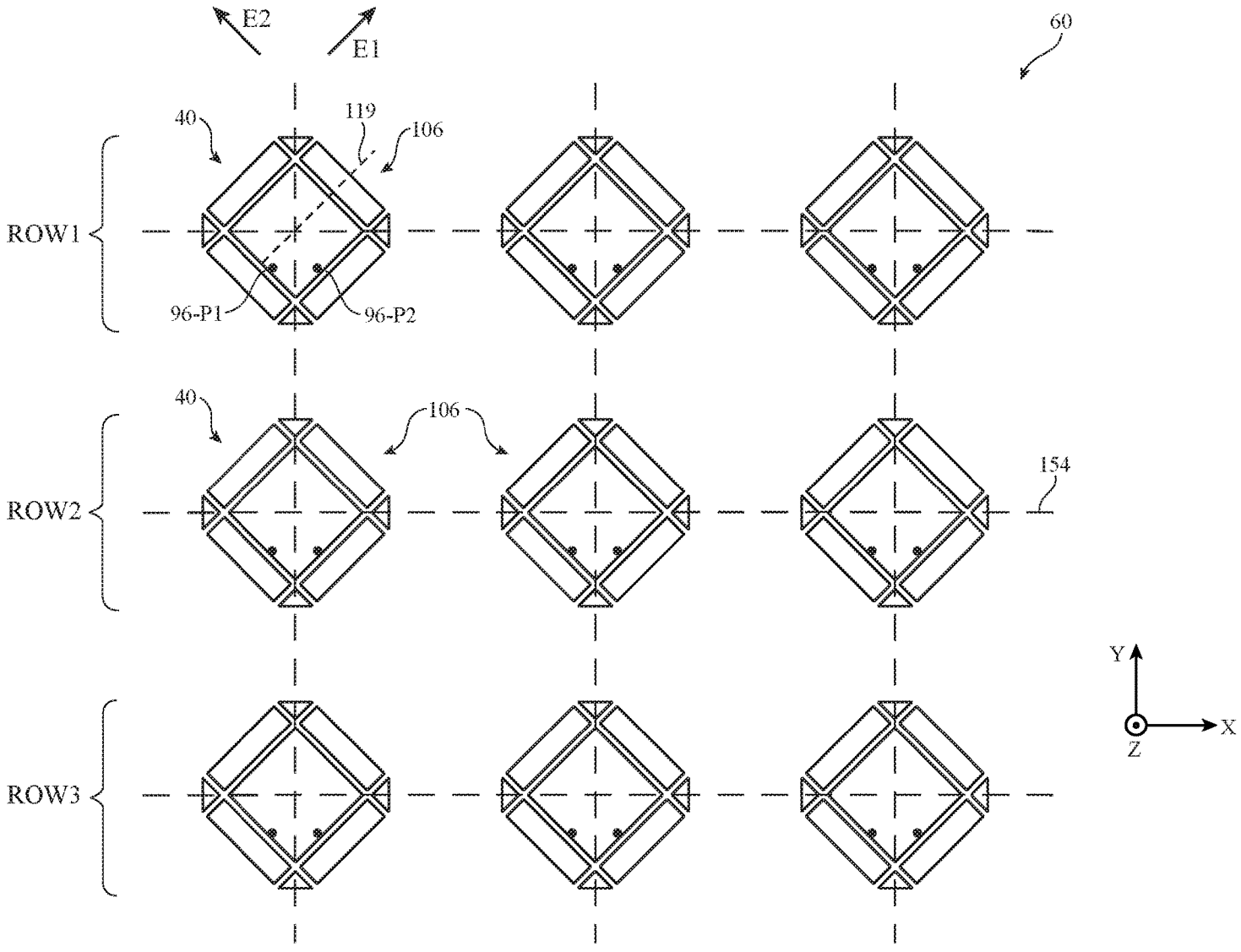
FIG. 14 is a top-down view of an illustrative phased antenna array including antennas arranged in grid and rotated by 45° relative to the grid in accordance with an embodiment.

FIGS. 13 and 14 are top views of illustrative phased antenna arrays with antennas arranged to maximize the number of antennas per unit volume while maintaining isolation between the antennas. In FIGS. 13 and 14, the parasitic element 106 of each antenna 40 is shown, including parasitic corner conductors (e.g., as shown in connection with FIGS. 10 and 11). Patch 104 of each antenna 40 is not shown in FIGS. 13 and 14 for the sake of clarity. However, the location of the first and second feed terminals 96-P1 and 96-P2 (on the underlying patch 104) are depicted in FIGS. 13 and 14 to help show the relative orientations of each antenna 40. The X-axis and Y-axis in FIGS. 13 and 14 may be parallel to walls of an antenna cavity.

As shown in FIGS. 13 and 14, the antennas are arranged in phased antenna array 60 and according to a grid pattern (e.g., grid 152). Grid 152 includes a first set of regularly-spaced grid lines and a second set of regularly-spaced grid lines that are perpendicular to the first set of grid lines. In the example of FIG. 13, the first and second sets of grid lines are rotated by 45° relative to the X-axis. This example is merely illustrative and, in general, grid 152 may be rotated at any desired angle with respect to the X-Y axes of FIG. 13.

Each row of antennas 40 in phased antenna array 60 is laterally offset from the adjacent rows of antennas in phased antenna array 60. For example, each antenna in row 2 is shifted so as to not be directly underneath an antenna in row 1 or directly above an antenna in row 3. The longitudinal axis 119 of each antenna may be parallel to the Y-axis. The longitudinal axis 119 of each antenna may be parallel to at least some edges of parasitic element. The longitudinal axis 119 of each antenna is oriented at an angle (e.g., a 45° angle) relative to the lines of grid 152. When using the antenna feed associated with feed terminal 96-P1, antenna 40 may transmit and/or receive antenna signals having a first polarization (e.g., the electric field E1 of antenna signals associated with feed terminal 96-P1 may be oriented parallel to dimension Y). When using the antenna feed associated with feed terminal 96-P2, antenna 40 may transmit and/or receive antenna signals having a second polarization (e.g., the electric field E2 of antenna signals associated with feed terminal 96-P2 may be oriented parallel to dimension X so that the polarizations associated with feed terminals 96-P1 and 96-P2 are orthogonal to each other).

Arranging the antennas as in FIG. 13 increases isolation compared to an embodiment where the antennas have the same orientation (e.g., with E1 parallel to the Y-axis) but are arranged in a square grid (e.g., such that each antenna is directly adjacent to antennas in adjacent rows without any lateral offset). Another arrangement having satisfactory antenna isolation is shown in FIG. 14.

As shown in FIG. 14, antennas 40 may be arranged in a phased antenna array 60 and according to a grid pattern (e.g., grid 154). In the grid of FIG. 14, however, the grid lines are parallel to either the X-axis or the Y-axis. Each row of antennas is formed directly above the underlying row of antennas without any lateral offset. However, to improve isolation, the antennas are rotated relative to the X-axis. For example, the longitudinal axis 119 of each antenna may be oriented at a 45° angle (or other desired angle) relative to the X-axis. Consequently, electric fields E1 and E2 (while still orthogonal) are orientated at 45° angles relative to the X-axis. This type of arrangement improves efficiency and isolation of the antennas in the phased antenna array compared to an embodiment where the antennas are arranged in the square grid of FIG. 14 but are not rotated (such that E1 is parallel to the Y-axis).

In the arrangement of FIG. 13, grid 152 is defined by grid lines that are at a 45° angle relative to the X-axis. This example is merely illustrative and if desired the grid of FIG. 13 may be defined by grid lines that are at other angles (e.g., between 30° and 60°, less than 60°, more than 20°, etc.) relative to the X-axis. Similarly, in FIG. 14 each antenna is rotated by 45° relative to the X-axis. This example is merely illustrative and the antennas may be rotated by any desired amount (e.g., between 30° and 60°, less than 75°, more than 15°, etc.). The arrangements of FIGS. 13 and 14 may be applied to any type of antenna (e.g., any of the antennas shown in FIGS. 5-12 or any other desired type of antenna).

Figure 15:
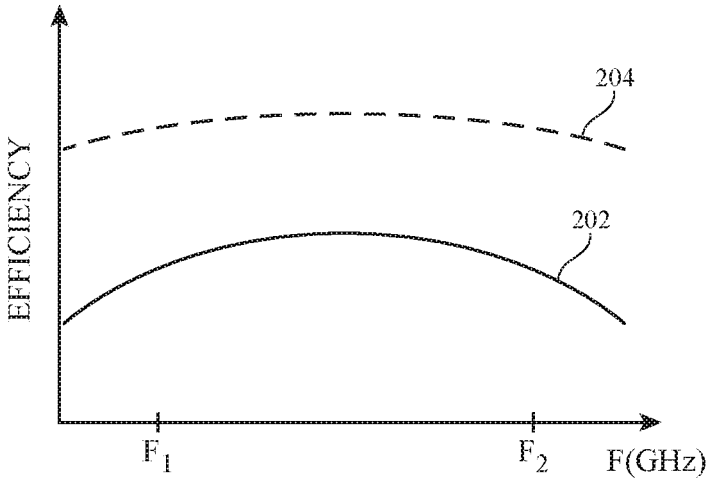
FIG. 15 is a graph of antenna efficiency for illustrative patch antennas of the types shown in FIGS. 5-12 in accordance with an embodiment.

FIG. 15 is a graph of antenna performance (antenna efficiency) as a function of frequency for illustrative antennas of the types shown in FIGS. 5-12. As shown in FIG. 15, curve 202 illustrates the efficiency of an antenna of the type shown in FIG. 6 (e.g., without a parasitic element). Curve 202 exhibits a peak antenna efficiency within a millimeter wave communications band of interest defined by lower threshold frequency F1 (e.g., 57 GHz) and upper threshold frequency F2 (e.g., 71 GHz). Curve 204 illustrates the efficiency of antenna 40 when formed using a parasitic antenna resonating element (e.g., as shown in FIGS. 7 and 8). Curve 204 exhibits a peak antenna efficiency within the millimeter wave communications band of interest between frequencies F1 and F2. However, curve 204 is shifted to a higher efficiency than curve 202 across the communications band of interest, showing the improved performance of the antenna when the parasitic antenna resonating element is included. These curves are merely illustrative. The efficiency of antennas with or without parasitic elements may have any other desired shapes.

Figure 16:
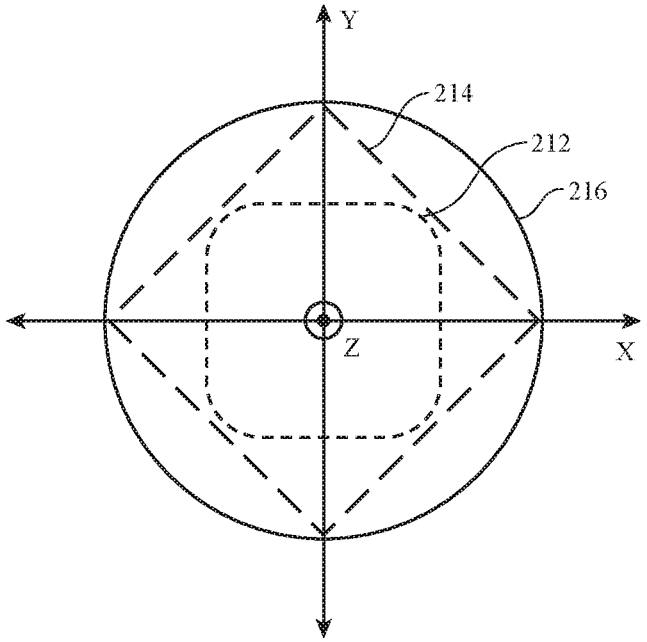
FIG. 16 is a graph of antenna radiation patterns for illustrative patch antennas of the types shown in FIGS. 5-12 in accordance with an embodiment.

FIG. 16 shows a diagram of illustrative radiation patterns for patch antennas with different parasitic element arrangements. In the perspective of FIG. 16, the antenna may lie in the X-Y plane and may radiate in the positive Z-direction. Curve 212 shows the radiation pattern of a patch antenna without a parasitic element (e.g., the antenna of FIG. 6). When a parasitic element is added to the antenna (e.g., as in the antenna of FIG. 9) the radiation pattern widens from curve 212 to curve 214. In other words, the presence of the parasitic element may increase the coverage area of the antenna. When parasitic corner conductors are added to the antenna (e.g., as in the antenna of FIG. 11), the radiation pattern again widens from curve 214 to curve 216. The presence of the parasitic corner conductors may increase the coverage area of the antenna and may optimize the uniformity of the radiation pattern. In particular, the parasitic corner conductors reduce angular variation in the radiation pattern. These curves are merely illustrative. The radiation pattern of antennas with or without parasitic elements and parasitic corner conductors may have any other desired shapes.

Optimizing the uniformity of the radiation pattern for the antenna (e.g., using the parasitic corner conductors of FIG. 11) may also optimize uniformity of the radiation envelope of a corresponding phased antenna array. In other words, forming a phased antenna array from antennas of the type shown in FIG. 11 optimizes uniformity of the radiation envelope. Additionally, a phased antenna array with an antenna arrangement of the type shown in FIG. 13 or FIG. 14 will have optimized isolation and therefore maximized gain.

Figure 17:
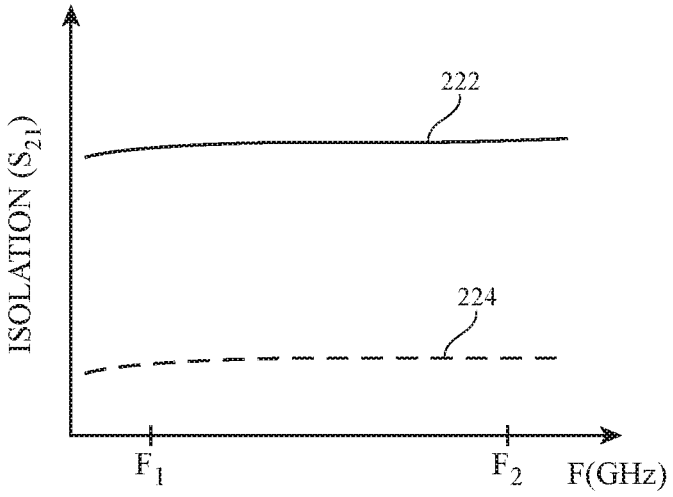
FIG. 17 is a graph of isolation for illustrative phased antenna arrays of the types shown in FIGS. 13 and 14 in accordance with an embodiment.

FIG. 17 is a graph of isolation ($S_{21}$) for antennas in an array. For example, curve 222 corresponds to an antenna in an array of antennas arranged in a grid without any lateral offset between adjacent rows and without any rotational adjustment of the antennas. Curve 224 corresponds to an antenna in an array of antennas in a grid with the antennas rotated by 45° relative to the grid lines (as shown in FIGS. 13 and 14, for example). As shown in FIG. 17, the arrangement of FIG. 14 improves isolation (with curve 224 having improved isolation relative to curve 222). These curves are merely illustrative. The isolation pattern of antennas with or without the isolating arrangements of FIGS. 13 and 14 may have any other desired shapes.

The foregoing is merely illustrative and various modifications can be made by those skilled in the art without departing from the scope and spirit of the described embodiments. The foregoing embodiments may be implemented individually or in any combination.

What is claimed is:

1. An antenna comprising:

an antenna ground;

a dielectric substrate having first and second layers, the first layer being interposed between the antenna ground and the second layer;

an antenna resonating element comprising first conductive traces on the first layer, wherein the antenna resonating element is configured to convey radio-frequency signals at a frequency greater than 10 GHz;

a parasitic element comprising second conductive traces on the second layer, wherein the second conductive traces comprise a set of rectangular conductive patches and a set of corner conductors, the set of corner conductors being located at corners of the parasitic element and separated from the set rectangular conductive patches by dielectric-filled openings, and wherein each corner conductor in the set of corner conductors has a first edge, a second edge that is perpendicular to the first edge, and a third edge coupled directly between the first and second edges; and an antenna feed having a first feed terminal coupled to the first conductive traces and a second feed terminal coupled to the antenna ground.

2. The antenna defined in claim 1, wherein the set of rectangular conductive patches comprises a first rectangular conductive patch with first and second opposing sides and third and fourth opposing sides, a second rectangular conductive patch at the first side, a third rectangular conductive patch at the second side, a fourth rectangular conductive patch at the third side, and a fifth rectangular conductive patch at the fourth side.

3. The antenna defined in claim 2, wherein the set of corner conductors comprises first, second, third, and fourth corner conductors, the second rectangular conductive patch is interposed between the first and second corner conductors, the third rectangular conductive patch is interposed between the third and fourth corner conductors, the fourth rectangular conductive patch is interposed between the second and third corner conductors, and the fifth rectangular conductive patch is interposed between the fourth and first corner conductors.

4. The antenna defined in claim 3, wherein the third edge of each corner conductor is curved.

5. The antenna defined in claim 3, wherein each of the first, second, third, and fourth corner conductors has a triangular shape and the third edge of each corner conductor forms a hypotenuse of the triangular shape.

6. The antenna defined in claim 3, wherein the second, third, fourth, and fifth rectangular conductive patches have respective widths and respective lengths that are longer than their respective widths, the lengths of the second conductive patch and the third conductive patch extend parallel to a first direction and the lengths of the fourth conductive patch and the fifth conductive patch extend parallel to a second direction that is perpendicular to the first direction.

7. The antenna defined in claim 2, further comprising:

an additional antenna feed having a third feed terminal coupled to the first conductive traces and a fourth feed terminal coupled to the antenna ground.

8. The antenna defined in claim 7, wherein the second rectangular conductive patch overlaps the first feed terminal and the fourth rectangular conductive patch overlaps the third feed terminal.

9. The antenna defined in claim 2, wherein the second rectangular conductive patch, the third rectangular conductive patch, the fourth rectangular conductive patch, the fifth rectangular conductive patch, and each one of the set of corner conductors are all smaller than the first rectangular conductive patch.

10. The antenna defined in claim 1, wherein each corner conductor of the set of corner conductors is triangular.

11. The antenna defined in claim 1, wherein the set of rectangular conductive patches comprises a first conductive patch with first and second opposing sides and third and fourth opposing sides, a second conductive patch at the first side, a third conductive patch at the second side, a fourth conductive patch at the third side, and a fifth conductive patch at the fourth side, the antenna further comprising:

an additional antenna feed having a third feed terminal coupled to the first conductive traces and a fourth feed terminal coupled to the antenna ground, wherein the second conductive patch overlaps the first feed terminal and the fourth conductive patch overlaps the third feed terminal.

12. An antenna comprising:

an antenna ground;

an antenna resonating element formed at a first distance from the antenna ground;

a parasitic element formed at a second distance from the antenna resonating element, wherein the parasitic element has first and second rectangular parasitic conductors and first, second, third, and fourth non-rectangular parasitic conductors that each have first and second perpendicular edges and a third edge that joins the first edge to the second edge, the first rectangular parasitic conductor being interposed between the first and second non-rectangular parasitic conductors, and the second rectangular parasitic conductor being interposed between the third and fourth non-rectangular parasitic conductors; and an antenna feed having a first feed terminal coupled to the antenna resonating element and a second feed terminal coupled to the antenna ground.

13. The antenna defined in claim 12, wherein the first, second, third, and fourth non-rectangular parasitic conductors have a triangular shape and the third edge of each of the first, second, third, and fourth non-rectangular parasitic conductors forms a hypotenuse of the triangular shape.

14. The antenna defined in claim 12, wherein the third edge of each of the first, second, third, and fourth non-rectangular parasitic conductors is curved.

15. The antenna defined in claim 12, wherein the parasitic element has a central parasitic conductor with first and second opposing sides and third and fourth opposing sides, the first rectangular parasitic conductor is formed at the first side of the central parasitic conductor, and the second rectangular parasitic conductor is formed at the second side of the central parasitic conductor.

16. The antenna defined in claim 15, wherein the parasitic element further comprises a third rectangular parasitic conductor formed at the third side of the central parasitic conductor and a fourth rectangular parasitic conductor formed at the fourth side of the central parasitic conductor.

17. The antenna defined in claim 16, wherein the third rectangular parasitic conductor is interposed between the second and third non-rectangular parasitic conductors and the fourth rectangular parasitic conductor is interposed between the fourth and first non-rectangular parasitic conductors.

18. The antenna defined in claim 17, further comprising:

an additional antenna feed having a third feed terminal coupled to the antenna resonating element and a fourth feed terminal coupled to the antenna ground, wherein the first rectangular parasitic conductor overlaps the first feed terminal and the third rectangular parasitic conductor overlaps the third feed terminal.

* * * * *